United States Patent [19]

Jones

[11] 4,022,095

[45] May 10, 1977

[54] PICTURE MAT CUTTER

[75] Inventor: Garnon Anthony Jones, Wymondham, England

[73] Assignee: Locality Arts Limited, England

[22] Filed: Jan. 6, 1976

[21] Appl. No.: 646,891

[30] Foreign Application Priority Data

Jan. 22, 1975 United Kingdom ..... 2694/75

[52] U.S. Cl. ..... 83/455; 83/581; 83/614

[51] Int. Cl.[2] ..... B26D 3/02

[58] Field of Search ..... 83/455, 614, 581

[56] References Cited

UNITED STATES PATENTS

| | | | |
|---|---|---|---|
| 513,851 | 1/1894 | Wheeler | 83/581 X |
| 3,213,736 | 10/1965 | Keeton | 83/455 |
| 3,292,477 | 12/1966 | Raftery | 83/614 X |
| 3,527,131 | 9/1970 | Ellerin et al. | 83/614 X |

*Primary Examiner*—Frank T. Yost

*Attorney, Agent, or Firm*—Oblon, Fisher, Spivak, McClelland & Maier

[57] ABSTRACT

A blade is carried in a housing which is adapted to slide along a guide rail with the blade depending from the housing and making sliding contact over at least a portion of the length of the blade with a blade guide which runs parallel to the guide rail. A portion of the blade protrudes below the blade guide to engage in and cut a cardboard mount or the like situated below the guide. The blade is inclined so that while the cutting edge is parallel to and slides along the blade guide the plane of the blade is itself inclined to the said blade guide surface. The blade is detachably secured in the housing for replacement and is arranged so that one corner of the cutting edge protrudes below the level of the blade guide. The blade mounting is adjustable within the housing so that the amount by which the corner of the blade extends below the blade guide can be adjusted to control the depth of cut.

6 Claims, 4 Drawing Figures

PICTURE MAT CUTTER

BACKGROUND OF THE INVENTION

1. Field of the Invention

This invention concerns cutting devices for cutting cardboard and the like and in particular to a cutting device commonly referred to as a mount cutter for cutting an aperture in a cardboard mount used for framing a picture or photograph. The cutting device in a mount cutter is arranged so that the edge of the aperture cut in the cardboard mount is inclined to the surface of the mount by an angle which is not equal to 90°. The object is to provide a bevelled edge to the aperture which is visible when the picture or photograph is viewed, the function of the bevelling being to give a feeling of depth when the picture or photograph is viewed.

2. Description of the Prior Art

A mount cutter is known such as that disclosed in U.S. Pat. No. 3,213,736 to William B. Keeton, in which a cutting blade is carried by a first housing member which is pivotally joined to a second housing member the latter being slidable along a rail which is in practice arranged parallel to the desired direction of cut. The pivot joint between the first and second housing members allows the blade to be lowered into contact with an inclined guide face located parallel to the rail and into the mount at the beginning of a cut and, after the cut has been made to be raised clear of the cut at the far end. However the pivot joint is subjected in use to not inconsiderable shear forces and wear at the bearing surfaces results in misalignment of the blade relative to the guide face. The wear at the pivot joint is cummulative with any wear which occurs between the second housing and the rail and the total effect can be considerable after this known mount cutter has been in use for some time.

SUMMARY OF THE INVENTION

It is an object of the present invention to provide an improved mount cutter which in particular does not suffer from the disadvantage caused by wear and characteristic of the known mount cutter described above.

It is another object of the invention to provide an improved mount cutter in which the cutting blade is detachable and replaceable with a fresh blade and in which the cutting blade is held against a positive but adjustable stop to control the depth of cut.

These objects and the general purpose of this invention are accomplished by a mount cutter comprising in combination a housing, a guide rail along which the housing is adapted to slide, a blade fixed to the housing and depending therefrom and a blade guide parallel to the guide rail against which the blade makes sliding contact over at least a portion of the length of the blade as the housing is slid along the guide rail, a portion of the blade protruding below the blade guide to engage in and cut a cardboard mount or the like below the guide. Forming the blade guide integrally with the guide rail simplifies the construction considerably and a preferred form of integral unit comprises an elongate member of inverted V-section with the blade guide surface comprising one of the outer V-section faces. The blade is located below a detachable plate to allow for replacement with one corner of the cutting edge of the blade lower than the other. A degree of tension is provided by mounting the blade with the plane of the blade inclined to the blade guide surface. The rear end of the blade abuts a positive stop which is adjustable relative to the housing to control the depth of cut.

BRIEF DESCRIPTION OF THE DRAWINGS

The exact nature of this invention as well as other objects and advantages thereof will be readily apparent from consideration of the following specification related to the annexed drawings in which like reference numerals designate like parts throughout the figures thereof and wherein.

GENERAL DESCRIPTION OF PREFERRED EMBODIMENTS

Figure 1:
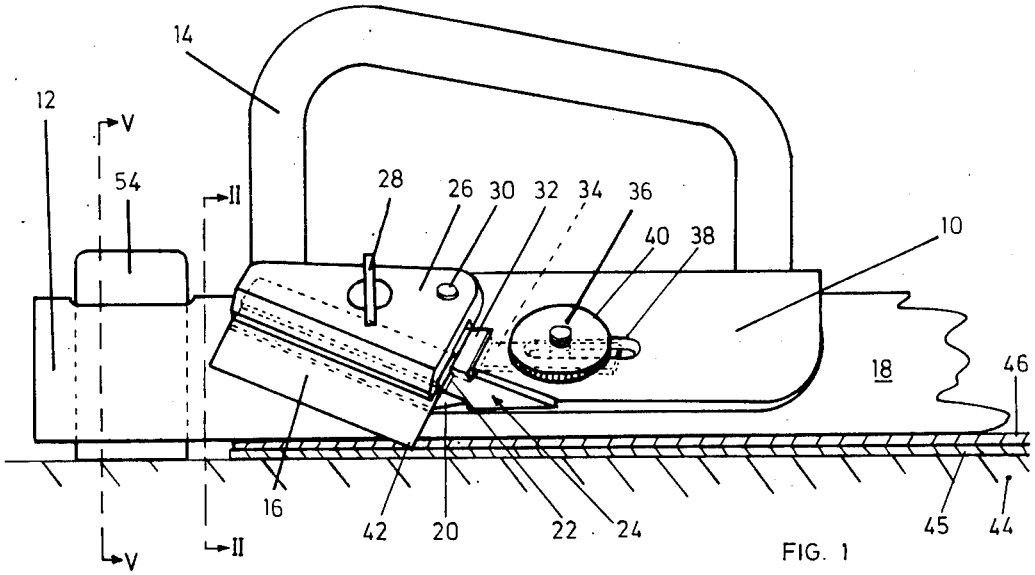
FIG. 1 is a side view of a mount cutter constructed as one embodiment of the invention situated at one end of an elongate inverted V section guide rail.
Figure 2:
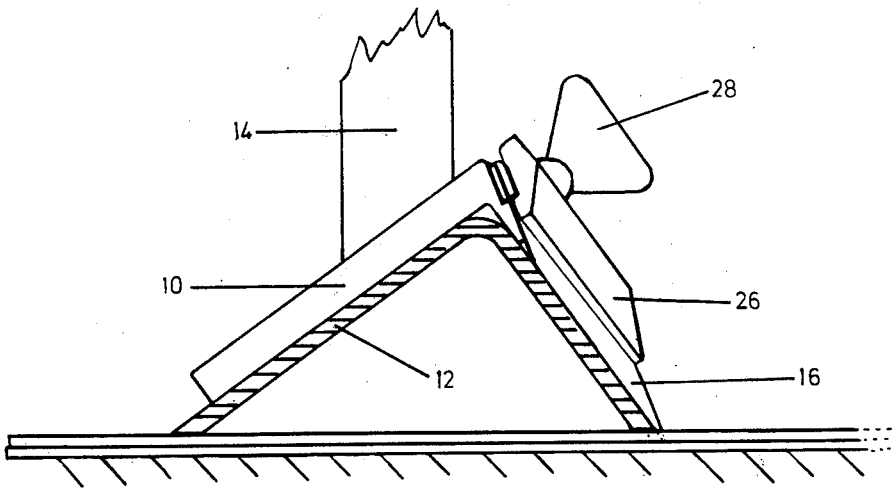
FIG. 2 is an end view of the mount cutter shown in FIG. 1 with the guide rail cross-sectioned on the line II—II in FIG. 1.

The mount cutter shown in the drawings comprises a single housing adapted for sliding along the length of a guide rail, a blade fixed to the housing for engaging in and cutting a cardboard mount or the like situated below the guide rail and an inclined surface parallel to the guide rail against which the blade makes sliding contact over at least a portion of the length of the blade.

Preferably the blade is located below a detachable plate which can be clamped on to the housing to allow for replacement of worn blades.

Preferably the blade is inclined so that one corner of the cutting edge is lower than the other and the blade is inclined so that while the cutting edge is parallel to and slides along the inclined surface, the plane of the blade is itself inclined to the said inclined surface.

Preferably the guide rail is an elongate member of inverted V-section and the inclined surface is one of the outer V-section faces.

The guide rail may to particular advantage also constitute a straight edge for laying on and trapping therebeneath the cardboard mount or like member which is to be cut.

The mount cutter according to the invention may be formed from metal or plastics or any combination thereof and the blade is conveniently a single edge razor blade with means being provided on or in the housing for locating the butt edge of the blade.

Preferably the rear end of the blade is engaged by a stop member provided on or in the housing and arranged to prevent the blade from sliding in a downward and rearward direction due to the force arising from friction between the card and the surface area of the blade in contact with it. Preferably the stop member against which the blade end abuts is adjustable in position so that the amount by which the lowermost corner of the cutting edge of the blade extends below the housing can be adjusted to thereby adjust the depth of cut.

The mount cutter and guide rail as provided by the invention may be combined with a cutting table having upstanding lugs for engaging in slots or like receiving apertures in the guide rail to locate the guide rail on the table. Clamping means may be provided for engaging a sheet of cardboard and retaining same on the table, the mount to be cut being laid on the sheet of cardboard and sandwiched between the underside of the guide rail and the cardboard on the table. The cardboard sheet under the mount is necessary to prevent the blade from being damaged by engagement between the blade and the table. The action of pushing down on the housing as it is pushed along the guide rail serves to urge the underside of the guide rail into contact with the mount and retain it and the cardboard in position whilst the cut is made.

Where the guide rail is an elongate member of inverted V-section the housing is most simply formed on its underside with an open V the included angle of which is commensurate with the vertex angle of the V-section of the guide rail and the housing is cut away over a portion thereof so that the cutting edge of the blade carried thereby can make sliding contact with an inclined surface of the V-section guide rail.

Preferably the housing includes a handle.

DETAILED DESCRIPTION OF THE PREFERRED EMBODIMENT ILLUSTRATED IN THE DRAWINGS

Referring to the drawings a mount cutter comprising a V-shaped housing 10 is located on and slidable along a V-section guide rail 12, the included angle of the inverted V-section of the housing 10 being commensurate with the corresponding angle of the V-section guide rail 12 so that the V-shaped underside of the housing 10 is a close slipping fit on the guide rail 12 and is accurately located thereby.

The housing 10 includes a handle 14 which extends in a generally upward direction from the housing 10 on one side of the V-section and on the other side is cut away to allow a razor blade 16 carried by the housing to make contact with the inclined surface 18 of the guide rail 12. In addition to being cut away, the housing, at its forward end on that side is formed with reducing thickness to produce a taper or wedge denoted by reference numeral 20 which causes the blade 16 which lies on the upper surface of the wedge section to be inclined at an angle of approximately 10° relative to the plane of the face 18. The thickened, butt edge of the blade 16 designated by reference numeral 22 is received in a parallel sided groove generally designated 24 and the blade is retained in the groove 24 by means of a detachable clamp 26 held in place by means of a screw 28 conveniently provided with a wing nut head to facilitate removal and/or tightening. The clamp 26 also includes a circular aperture through which a pin 30 extends, the pin being embedded in or otherwise secured to the housing 10 and serving to accurately locate together with the screw 28 the clamp on the housing.

The lower end of the groove 24 is cut away to receive an abutment 32 carried at one end of a slide shown in hidden detail at 34 having upstanding therefrom a threaded pin 36 which is slidably received in a slot 38 formed in the housing 10 and a knurled circular nut 40 threaded on the pin 36 serves to hold the slide 34 and abutment 32 in position on being tightened against the housing 10. Thickness of the slide 34 is made approximately one-half the thickness of the plate from which the housing 10 is formed and although not shown the underside of the plate is formed with a parallel sided groove in which the slide 34 is received so that the underside of the plate forming the housing 10 is smooth surface.

By slackening the screw 28 and circular nut 40, the abutment 32 can be slid in a forward direction thereby causing the blade 16 to slide in a generally upward direction and after the desired position has been obtained, the blade can be securely clamped in place by tightening the screw 28 and the nut 40. The desired position for the blade is that in which the lowermost corner of the cutting edge designated by reference numeral 42 extends in a downward direction below the rail 18 by just a sufficient amount as to produce an appropriate depth of cut in the cardboard or other sheet material to be cut.

Figure 3:
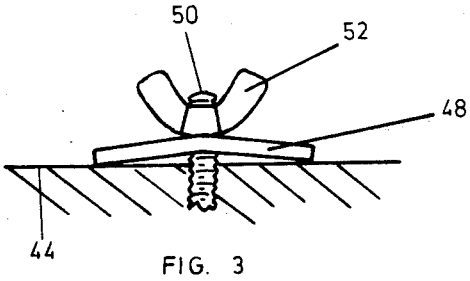
FIG. 3 illustrates, end on, a clamp for receiving and clamping a backing sheet of cardboard to serve as a support for a mount.

The rail 18 is conveniently located on a cutting table generally designated 44 with a backing sheet of cardboard 45 and a mount 46 trapped beneath the guide. As shown in FIG. 3, a clamp may be provided designated by reference numeral 48 for trapping the edge of the cardboard backing sheet and to this end a threaded pin 50 extends upwardly from the table 44 to receive a wing nut 52 for tightening the clamp 48 onto the cardboard backing sheet.

Figure 4:
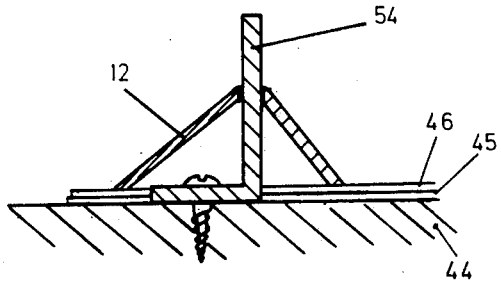
FIG. 4 is an end view through the guide rail and supporting lug of FIG. 1 cross-sectioned on the line V—V of FIG. 1.

As shown in FIGS. 1 and 4, the guide 12 may be located in position on the table 44 by means of one or more upstanding lugs 54 which themselves may be in the form of an L and are screwed to the table 44.

In use the housing is located at the right hand end of the cut to be made and the left hand forward end of the housing (as viewed in FIG. 1) is first of all lowered onto the vertex of the V-section guide with the rear right hand end of the housing in a raised position relative to the front end thereof. The housing is then pivoted about the front end which is in contact with the vertex of the V-section rail until the rear tip 42 of the cutting edge of the blade 16 is just above the cardboard and a final adjustment of the position of the housing 10 is made so that the tip 42 of the blade will just enter the cardboard at the point from which the cut is required to start. The rearward end of the housing 10 is then lowered along the same plane as 18 of the V-shaped rail 12 thereby causing the tip of the blade 42 to enter the cardboard sheet and, maintaining a downward push on the handle 14, the housing is urged in a forward direction along the rail 12. When the opposite end of the cut is reached, the housing is tilted in the reverse direction from that at the beginning of the cut so that the rear end of the housing 10 is lifted clear of the rail and in so doing the tip 42 of the blade is lifted clear of the cardboard.

Obviously many modifications and variations of the present invention are possible in the light of the above teachings. It should be understood that within the scope of the appended claims the invention may be practiced otherwise than as specifically described.

What is claimed is:

1. A mount cutter comprising:

a housing;

a guide rail along which the housing is adapted to slide;

a blade fixed to said housing and depending therefrom to make sliding contact with said guide rail over at least a portion of the length of the blade as the housing is slid along said guide rail, said blade being a single edge razor type blade having a sharp edge and a butt edge, and a portion of said blade protruding below said guide rail for engaging in and cutting sheet material located below said guide;

means on said housing for locating said butt edge of said blade;

a stop member on said housing adapted to be engaged by the rear lower end of said blade to prevent said blade from sliding in a downward and rearward direction due to forces arising from friction between said blade and said sheet material during cutting thereof; and means for adjusting the position of said stop member to control the amount by which the lowermost corner of the cutting edge of said blade extends below said housing for adjusting the depth of the cut.

2. A mount cutter as set forth in claim 1 further comprising a detachable plate and means for clamping the plate to the housing to trap therebetween the blade.

3. A mount cutter as set forth in claim 1 wherein the blade is inclined so that while the cutting edge is parallel to and slides along the blade guide surface the plane of the blade is itself inclined to said blade guide surface.

4. A mount cutter as set forth in claim 1 wherein the guide rail is an elongate member of inverted V-section.

5. A mount cutter as set forth in claim 4 wherein the housing is formed on its underside with an open V the included angle of which is commensurate with the vertex angle of the V-section of the guide on which the housing runs and the housing is cut away over a portion thereof so that at least a portion of the cutting edge of the blade carried thereby can make sliding contact with one inclined surface of the V-section guide rail.

6. A mount cutter as set forth in claim 1 further comprising a handle on said housing.

* * * * *